United States Patent [19]

Kempf et al.

[11] 4,080,249

[45] Mar. 21, 1978

[54] DELIGNIFICATION AND BLEACHING OF A LIGNOCELLULOSIC PULP SLURRY WITH OZONE

[75] Inventors: Arthur W. Kempf, Warwick; Richard B. Phillips, Tuxedo Park, both of N.Y.

[73] Assignee: International Paper Company, New York, N.Y.

[21] Appl. No.: 705,869

[22] Filed: Jul. 16, 1976

Related U.S. Application Data

[63] Continuation-in-part of Ser. No. 692,062, Jun. 2, 1976, abandoned.

[51] Int. Cl.[2] ..... D21C 9/10

[52] U.S. Cl. ..... 162/57; 8/111; 162/65; 162/78; 162/89

[58] Field of Search ..... 162/57, 65, 78, 88, 162/89, 90; 8/107, 109, 108 R, 108 A, 111

[56] References Cited

U.S. PATENT DOCUMENTS

| | | | |
|---|---|---|---|
| 3,318,657 | 5/1967 | Wade | 8/111 |
| 3,352,642 | 11/1967 | Heidt et al. | 23/222 |
| 3,619,350 | 11/1971 | Marchfelder | 162/88 X |
| 3,663,357 | 5/1972 | Liebergott | 162/65 |
| 3,806,404 | 4/1974 | Liebergott et al. | 162/65 |
| 3,829,357 | 8/1974 | Thompson et al. | 162/65 X |

FOREIGN PATENT DOCUMENTS

| | | |
|---|---|---|
| 902,861 | 6/1972 | Canada. |
| 970,111 | 7/1975 | Canada. |

OTHER PUBLICATIONS

Soteland et al., Norsk Skogindustri[2] 1968: 46.

*Primary Examiner*—Arthur L. Corbin

[57] ABSTRACT

A process for the delignification and bleaching of a lignocellulosic pulp slurry, having a consistency between about 1% and 10%, by weight of oven-dried pulp, and a pH between about 1 and 7, while at a temperature between about 0° C. and 70° C., with a gaseous mixture selected from the group consisting of ozone/oxygen, ozone/air, and a mixture thereof. The ozone containing gaseous mixture, which has an ozone concentration of from about 0.1% to about 20%, by weight of oxygen or air, is bubbled into the pulp slurry, while agitating the pulp slurry at a rate of about 0.01 to 5.0 horsepower-days per ton of pulp.

15 Claims, 1 Drawing Figure

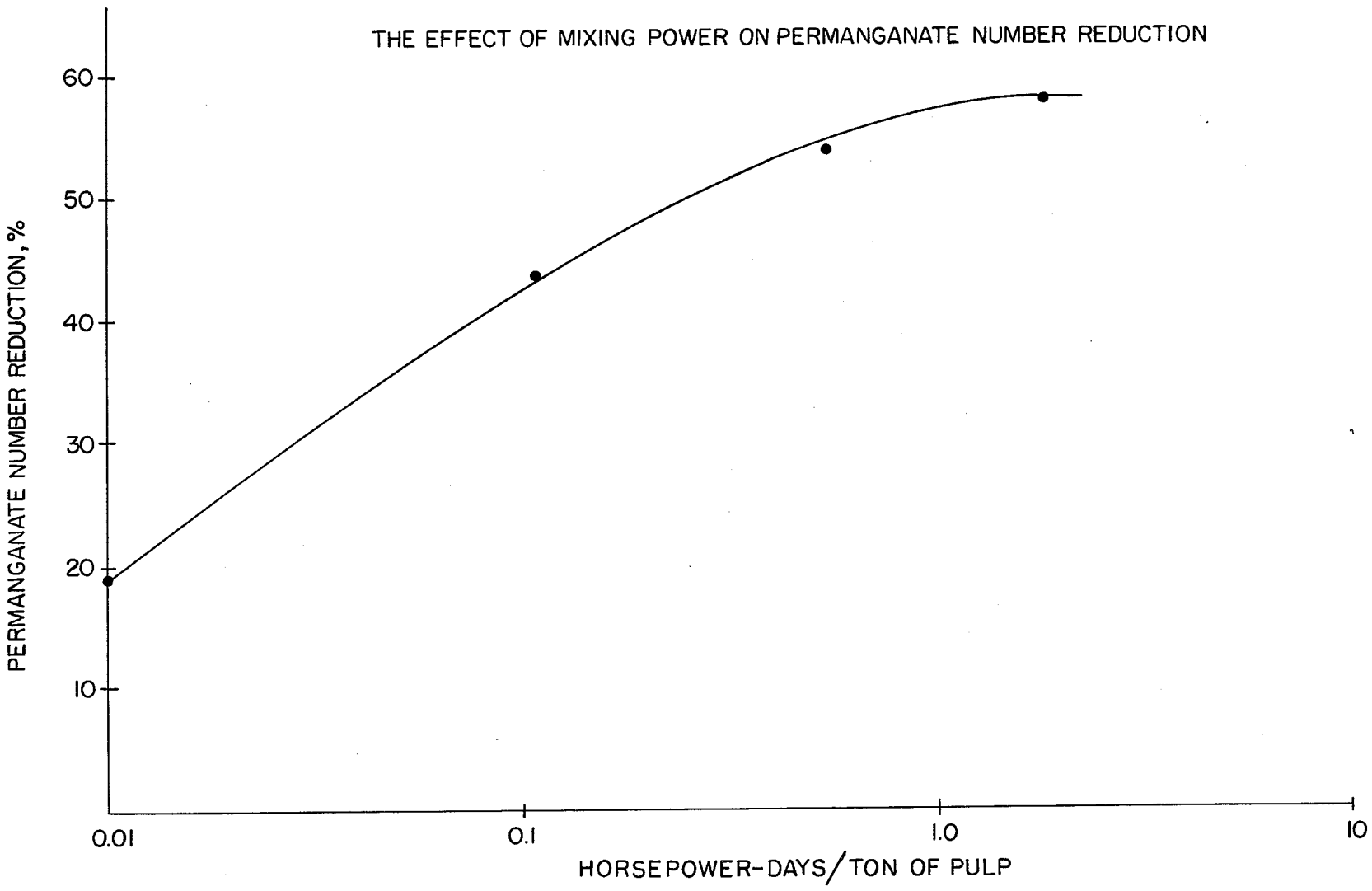
THE EFFECT OF MIXING POWER ON PERMANGANATE NUMBER REDUCTION
PERMANGANATE NUMBER REDUCTION, %
60
50
40
30
20
10
0.01
0.1
1.0
10
HORSEPOWER-DAYS/TON OF PULP

DELIGNIFICATION AND BLEACHING OF A LIGNOCELLULOSIC PULP SLURRY WITH OZONE

CROSS-REFERENCE TO RELATED APPLICATIONS

This is a continuation-in-part application of application Ser. No. 692,062, filed June 2, 1976, of Arthur W. Kempf and Richard B. Phillips, entitled, "Delignification and Bleaching of a Lignocellulosic Pulp Slurry with Ozone", now abandoned.

BACKGROUND OF THE INVENTION

The present invention relates generally to a method of bleaching and delignifying lignocellulosic pulps. More particularly, the invention relates to a method of bleaching and delignifying lignocellulosic pulps with ozone.

In recent years the pulp and paper industry has devoted substantial efforts to the development of chlorine-free or reduced chlorine bleaching processes. A milestone in this long range effort has been the development and implementation of oxygen bleaching systems generally, and particularly the low consistency oxygen bleaching process described in Roymoulik et al., U.S. Pat. No. 3,832,276.

Oxygen bleaching, however, is only a partial solution to the chlorine-free concept, since oxygen bleaching by itself cannot produce pulps of sufficiently high brightness and quality. One route which has been investigated by a number of researchers is to employ ozone as a bleaching agent, either alone or following an oxygen bleaching stage, since ozone has the capability of bleaching pulps to high brightness and is free of chlorine. Recent publications relating to ozone bleaching of wood pulps include Rothenberg et al. (Tappi 58 [8] 1975: 182); N. Soteland and K. Kringstad (Norsk Skogindustri [2] 1968:1); R. B. Secrist and R. P. Singh (Tappi 54 [4] 1971:581); Z. Osawa and C. Schuerch (Tappi 46 [2] 1963:79). U.S. Pats. relating to the ozone bleaching of fibrous materials, include: Nos. 396,325, 1,760,042, 1,957,937, 2,466,633, 3,049,394, 3,149,906, 3,318,657, 3,352,642, 3,451,888, 3,663,357, 3,806,404, and 3,829,357, and Canadian Pat. Nos. 902,861, 966,604 and 970,111.

The above-cited literature and patent references generally describe gas phase ozone bleaching of fibrous materials having consistencies in the range of 15% to 75%. The references disclose that the optimum conditions for ozone bleaching fall within the range of 30% to 60% consistency. When operating at such consistencies, a number of advantages are realized. Among these advantages are reaction times of relatively short duration, namely, from 1 minute to 60 minutes, and acceptable ozone utilization. However, there are also a number of disadvantages associated with high consistency processes for bleaching pulp with ozone. These include: (1) the necessity of employing expensive process equipment, e.g., high consistency presses, pulp fluffers and high consistency stock pumps; (2) the danger of pulp fires at these relatively dry conditions; and (3) difficulty in de-gassing pulp after treatment with ozone which can result in severe washer operation problems.

In an attempt to avoid the difficulties associated with ozone bleaching at high consistency, a number of investigators have experimented with ozone bleaching at low pulp consistency. The ability to successfully employ pulp at low consistency in ozone bleaching would avoid the difficulties described above.

Accordingly, Osawa and Schuerch (Tappi 46 [2] 1963:79) compared ozone bleaching of kraft pulp at 1% pulp consistency and 50% pulp consistency, respectively, at neutral pH. They concluded that the rate of ozonation is highest when it is carried out in the gas phase on fibers well above the fiber saturation point, i.e., 19%–20% consistency, and is much slower when the fibers are suspended in water.

Soteland and Kringstad (Norsk Skogindustri [2] 1968:1) confirmed the findings of Osawa and Schuerch when treating mechanical pulps at neutral pH with 2.25% ozone (w/w) in oxygen. They observed that, "Preliminary investigations showed that ozone passes through a suspension of mechanical pulp in water (concentration for instance between 0.1 and 0.2%) without being consumed to any significant degree." They found that the addition of 10% (v/v) of a suitable organic solvent, such as methyl or ethylacetate, acetic acid or acetone to the suspension was necessary to catalyze the reaction of ozone with the pulp. Similarly, Osawa and Schuerch also observed and noted that the presence of nitromethane or methylacetate serve to catalyze the reaction of ozone with pulp.

SUMMARY OF THE INVENTION

It has now quite unexpectedly been found, and contrary to the findings of Osawa et al. and Soteland et al., that an efficient process for the delignification and bleaching of lignocellulosic pulps is achieved by reacting a lignocellulosic pulp slurry, having a consistency between about 1% and 10%, by weight of oven-dried pulp, and a pH between about 1 and 7, while at a temperature between about 0° C. and 70° C., with a gaseous mixture selected from the group consisting of ozone/oxygen, ozone/air, and mixtures thereof. The ozone containing gaseous mixture, which has an ozone concentration of from about 0.1% to about 20%, by weight of oxygen or air, is bubbled into the pulp slurry, while agitating the pulp-water-gas mixture at a rate of about 0.01 to 5.0 horsepower-days per ton of pulp. Employing the foregoing reaction conditions eliminates the necessity of employing an organic solvent to catalyze the reaction as taught by Osawa et al. and Soteland et al. The process of the present invention results in high ozone utilization, rapid reaction rate, improved brightness, and extensive delignification of unbleached and partially bleached pulps.

DESCRIPTION OF THE DRAWING

The FIGURE is a logarithmic plot comparing reduction in permanganate number as a function of horsepower-days/ton of pulp.

DETAILED DESCRIPTION OF THE INVENTION

The lignocellulosic pulp fibers employed can either be unbleached or partially bleached, as, for example, by a prior oxygen bleach in the presence of alkali. If a prior oxygen bleach is done in the presence of alkali, it can be done at either high pulp consistency or at low pulp consistency. An example of such low consistency oxygen/alkali pulp bleaching process is disclosed in Roymoulik et al., U.S. Pat. No. 3,832,276.

The bleached or unbleached pulp can be either a paper grade pulp or a dissolving grade pulp prepared by chemical, chemimechanical or mechanical pulping processes. Exemplary of such processes are the kraft process, the sulfite process, neutral sulfite semichemical process or the groundwood process. The particular lignocellulosic materials subjected to the aforementioned pulping processes can include hardwoods, softwoods, grasses, etc.

While the pulp consistency in accordance with the subject process can be from about 1% to about 10%, by weight, it has been found preferable that it be between about 1% and about 5%, with a 3% consistency being especially preferred.

The pulp slurry is bleached in a suitable reactor which is provided with agitation means. The reactor can either be pressurized or unpressurized and should be provided with means for the admission of the ozone containing mixture in the form of a finely divided gaseous stream.

The pulp slurry is acidified using either an acid, including for example sulfuric acid, acetic acid, etc., or the effluent from a previous or a subsequent bleaching stage, such as chlorination, chlorine dioxide, hydrogen peroxide, peracetic acid, sodium hypochlorite, etc., to a pH between about 1 and about 7. A pH between about 3 and 5 has, however, been found to be preferable. While the bleaching and delignification process can be conducted when the temperature of the slurry is within the range of from about 0° C. to about 70° C., it is preferred to operate at a temperature of from about 20° C. to about 30° C.

The ozone containing gaseous stream is introduced into the reaction vessel containing the acidified pulp slurry. The finely divided gas stream can contain from about 0.1% to about 20%, by weight, of ozone; preferably, however, it should contain between about 2% and about 3%. The gas stream containing ozone is admitted into the pulp slurry via a sparging device, for example a porous disc or a sparging ring, containing a plurality of openings.

In the practice of the process of the present invention, it has been found desirable to employ an ozone containing stream of gas where substantially all of the bubbles are about ⅛ inch in diameter or less.

It is essential that the pulp slurry be agitated while being contacted and reacted with the gas stream containing ozone. The agitation can be accomplished in various ways, with mechanical agitation being preferred, as for example, by a multibladed propeller mixer or a turbine mixer. In order to attain the extent of delignification and the increase in brightness sought in the present process, it is essential that between about 0.01 to about 5.0 horsepower-days of energy be expended per ton of pulp. Mixing energies from about 0.1 to about 1.0 horsepower-days/ton of pulp gives the best balance between bleaching response and power usage.

The period of time for effecting delignification and brightening in accordance with the process of the subject invention is from about 1 minute to about 60 minutes, with from about 10 minutes to about 20 minutes having been found to be preferred. During the period of reaction, it is desirable that from about 0.1% to about 5.0% of ozone, by weight of O.D. pulp, be applied to the pulp slurry.

To obtain a final Elrepho brightness of 80 or above when employing hardwood pulp in accordance with the process of the present invention, a bleaching sequence might include a first stage employing oxygen in the presence of alkali on an unbleached low consistency pulp, i.e., less than 10%, (as taught by Roymoulik et al., U.S. Pat. No. 3,832,276), followed by ozone bleaching in accordance with the present invention, and finally a peroxide or peracetic acid stage. In order to bleach softwoods to a final Elrepho brightness of 80 or above, a bleaching sequence might include a first stage oxygen bleach, followed by an ozone bleach in accordance with the present process in a second stage, then followed by an extraction stage with sodium hydroxide or water, followed by another ozone bleaching stage, and then by a peroxide, peracetic acid, chlorine dioxide or hypochlorite stage. In certain instances another extraction stage followed by a P, Pa, D or H stage might prove desirable. Naturally, depending upon the end result sought, quite a variety of bleaching stages employing the ozone process of the present invention along with other bleaching chemicals might be utilized, in addition to the stages and chemicals previously mentioned.

By employing the low consistency ozone bleaching process of the present invention—which requires no additives, protectors or catalysts as taught by the prior art—many advantages and benefits are obtained over the high consistency ozone process taught by the prior art. These are: (1) lower equipment costs; (2) improved efficiency and ease of oxygen recovery, (since in a high consistency reactor the pulp fibers would be carried over from the reactor to the oxygen recovery system); (3) minimal hazards from pulp fires, (since the low consistency process operates at a high moisture content while in the high consistency process the fibers have very low moisture content); (4) improved control over the extent of bleaching, (since in the low consistency process there is no dependency on the degree of fluffing as one experiences in high consistency pulp bleaching); and (5) the ability to maintain the ozone bleaching stage at a lower temperature than possible with high consistency ozone bleaching.

In order to disclose more clearly the nature of the present invention, the following examples illustrating the invention are given. It should be understood, however, that this is done solely by way of example and is intended neither to delineate the scope of the invention nor limit the ambit of the appended claims.

EXAMPLES 1-3

160 grams, oven-dried (O.D.) basis, of an unbleached hardwood pulp, prepared by the kraft process, was placed in a 20-liter baffled plexiglass reactor and diluted with water to give a pulp slurry having a consistency of 1%. The reactor contained a centrally mounted three-bladed propeller mixer which was operated at 1/3th horsepower and 1200 rpm. A four inch diameter sintered glass sparge disc, having a plurality of openings measuring 70 to 100 microns, was centered in the bottom of the reactor. The pulp slurry which had a pH of 7 and a temperature of 20° C. was contacted by an ozone/oxygen mixture which was sparged through the disc at the rate of 12.4 SCFH (Standard Cubic Feet per Hour). The gas mixture contained 2.5%, by weight, of ozone in oxygen. The reaction was conducted for the periods of time and at the ozone application levels indicated below in Table I.

TABLE I

| | Unbleached Control | 1 | 2 | 3 |
|---|---|---|---|---|
| Ozone Applied, % | — | 1.0 | 3.0 | 5.0 |
| Permanganate No. | 9.5 | 6.9 | 3.8 | 2.6 |
| Viscosity, cp | 31.8 | 19.0 | 15.0 | 10.1 |
| Brightness, (EL) | 33.4 | 41.1 | 54.3 | 65.6 |

TABLE I-continued

| | Unbleached Control | 1 | 2 | 3 |
|---|---|---|---|---|
| Time, Min. | — | 4.6 | 15.0 | 24.4 |
| HP-Days/Ton (Pulp) | — | 0.178 | 0.583 | 0.949 |

The results shown in Table I above indicate that the process of the present invention is operative over a wide range of ozone application levels. In Example 3, extensive delignification was obtained after a reaction time of only 24.4 minutes.

EXAMPLES 4–7

The procedure employed in Examples 1–3 was repeated using a different hardwood kraft pulp. The only other changes in conditions involved the use of 3.5%, by weight, of ozone in oxygen and a total gas flow rate of 4.0 SCFH. The reaction was conducted for the time periods and at the ozone applications indicated below in Table II.

TABLE II

| | Un-bleached Control | 4 | 5 | 6 | 7 |
|---|---|---|---|---|---|
| Ozone Applied, % | — | 0.2 | 0.6 | 0.8 | 1.0 |
| Permanganate No. | 9.7 | 8.9 | 7.8 | 6.7 | 6.4 |
| Viscosity, cp | 23.8 | 23.6 | 20.8 | 15.0 | 14.1 |
| Brightness, % (El) | 30.6 | 35.4 | 38.3 | 42.2 | 41.6 |
| Time, Min. | — | 3.5 | 10.4 | 15.1 | 17.0 |
| HP-Days/Ton (Pulp) | — | 0.136 | 0.404 | 0.587 | 0.660 |

The results shown in Table II indicates that a linear relationship exists for delignification vs. ozone application levels. The data shown in Table II further illustrate the applicability of the present invention at ozone application levels of 1% and below.

EXAMPLES 8–12

The procedure employed in Examples 1–3 was repeated using the same hardwood kraft pulp. The pulp consistency was 1% and the temperature of the pulp slurry was 20° C. The concentration of the ozone was 2.6%, by weight of oxygen. 1% of ozone, by weight of pulp, was applied for 4.5 minutes at a flow rate of 12.4 SCFH. A sparge disc having 25 to 50 micron pores was employed. Each of the experiments represented by the examples was conducted at the pH's shown below in Table III.

TABLE III

| | Bleached Control | 8 | 9 | 10 | 11 | 12 |
|---|---|---|---|---|---|---|
| pH | — | 3.0 | 4.9 | 7.1 | 9.1 | 11.9 |
| Permanganate No. | 9.5 | 5.1 | 6.2 | 7.3 | 7.1 | 8.7 |
| Viscosity, cp | 31.8 | 16.6 | 18.5 | 19.9 | 23.7 | 28.7 |
| Brightness, % (El) | 33.4 | 55.1 | 47.7 | 41.8 | 41.9 | 36.8 |
| HP-Days/Ton (Pulp) | — | 0.178 | 0.178 | 0.178 | 0.178 | 0.178 |

The results obtained, as shown in Table III, indicate that while the process of the present invention is operative at acidic as well as basic pH's, the preferred pH range for obtaining maximum delignification and brightness is from about pH 3 to about pH 5.

EXAMPLES 13–14

A hardwood kraft pulp which had been bleached initially with oxygen in the presence of alkali at 4.5% consistency was bleached essentially in accordance with the procedure employed in Examples 1–3. However, instead of using a propeller mixer, a turbine blade mixer operating at 1/30th horsepower and 540 rpm was employed. The temperature of the pulp slurry was 20° C. The ozone concentration was 3.5%, by weight of oxygen, and the flow rate of oxygen/ozone was 4 SCFH. A sparge disc having 25 to 50 micron pores was employed. The reaction was conducted at pulp consistencies of 1% and 2% as indicated below in Table IV.

TABLE IV

| | Un-bleached Control | Oxygen Bleached Control | 13 | 14 |
|---|---|---|---|---|
| Ozone Applied, % on pulp | — | — | 1.0 | 1.0 |
| Pulp Consistency | — | — | 1.0 | 2.0 |
| pH | — | — | 3.0 | 3.2 |
| Permanganate No. | 9.5 | 6.1 | 2.4 | 2.7 |
| Viscosity, cp | 31.8 | 18.3 | 13.3 | 13.4 |
| Brightness, % (El) | 33.4 | 46.2 | 72.3 | 66.4 |
| Time, Min. | — | — | 17.7 | 37.0 |
| HP-Days/Ton (Pulp) | — | — | 2.32 | 2.32 |

The results in Table IV indicate that extensive delignification and brightening occurs when the process of the present invention is applied after the pulp has been bleached initially with oxygen.

EXAMPLES 15–18

The procedure employed in Examples 1–3 was repeated using the same hardwood kraft pulp. The pulp consistency was 1%, the slurry temperature was 20° C., and the pH was 7. The ozone was applied for 14.0 minutes at a flow rate of 12.4 SCFH using a sparge disc with a porosity of 70–100 microns. The ozone concentration was 2.6%, by weight of oxygen, and 3% ozone was applied, by weight of O.D. pulp.

TABLE V

| | Unbleached Control | 15 | 16 | 17 | 18 |
|---|---|---|---|---|---|
| Ozone Applied, % on pulp | — | 3.0 | 3.0 | 3.0 | 3.0 |
| Permanganate No. | 9.5 | 7.7 | 5.4 | 4.4 | 4.0 |
| Viscosity, cp | 31.8 | 21.9 | 16.1 | 15.6 | 11.53 |
| Brightness, % | 33.4 | 39.1 | 46.0 | 47.6 | 57.5 |
| Permanganate No. Reduction, % | — | 18.9 | 43.2 | 53.7 | 57.9 |
| HP-Days/Ton (Pulp) | — | 0.010 | 0.108 | 0.544 | 1.837 |
| Mixing, RPM | — | 300 | 700 | 1200 | 1800 |

It is obvious from Table V and FIG. 1 that satisfactory ozone bleaching can be achieved using from 0.01–1.8 HP-days/ ton of pulp mixing energy. The graph indicates a leveling-off of permanganate number reduction between 1 to 2 HP-days/ton of pulp. Therefore, mixing energies above 1 HP-days/ton of pulp provide little additional benefit. These results show the ozone treatment is greatly dependent on proper mixing of the gas-liquid-pulp mixture to allow for intimate contact of ozone with the reactive sites in the pulp fiber.

EXAMPLE 19

The procedure employed in Examples 1–3 was repeated using a hardwood kraft pulp which had the following physical properties: Permanganate number 9.5, viscosity, 31.8 cp and brightness (El) 33.4. The pulp consistency was 1%, the temperature of the pulp slurry was 20° C. and the pH of the slurry was 3. The concentration of the ozone was 3.3%, by weight of oxygen. 1% of ozone, by weight of pulp, was applied for 4.5 minutes at a flow rate of 12.4 SCFH while agitating at 1200 rpm (equivalent to about 0.178 horsepower-days/ton of pulp). 62% of the ozone applied was consumed. A sparge disc having 25 to 50 microns pores was employed.

The pulp brightness was increased to 55.1 points (El), which represents a 64.9% increase, and the permanganate number was reduced to 5.1, which represents a 46.3% decrease.

EXAMPLE 20

A slurry of unbleached hardwood kraft pulp having a consistency of 4.5%, by weight, was initially bleached with oxygen in the presence of alkali. Thereafter, the pulp slurry, which had a consistency of 1%, by weight, and a pH of 3 was bleached with an ozone/oxygen mixture passed through a sparge disc having 25–50 micron pores at a rate of 2.2 SCFH. The slurry was agitated with a turbine blade mixer at 3.26 HP-days/ ton of pulp. After having consumed 1.03% ozone, the pulp which had a brightness of 77.2 (El) was bleached with 1.1% peracetic acid. During the peracetic acid bleaching stage, the starting pH was 8.0, the pulp consistency was 10% and the temperature was 70° C. This bleaching stage lasted for four hours. Bleached pulp from this stage was then treated with aqueous sulfurous acid at 50° C. and pH 4.0 for a period of 30 minutes. The final brightness of the pulp was 87.9 (El).

Between each individual bleaching stage in this Example, as well as in Examples 21, 22 and 23 which follow, the pulp was washed with deionized water until the pH of the filtrate was neutral.

Table VI below provides pertinent data for the properties of the pulp at various stages in the bleaching sequence.

TABLE VI

| Pulp Property | Unbleached Kraft | Oxygen Bleached | Ozone Bleached | $O_2O_3Pa$ Bleached |
|---|---|---|---|---|
| Permanganate No. | 9.7 | 6.1 | 2.3 | — |
| Viscosity, cp | 23.8 | 16.7 | 12.93 | 12.38 |
| Brightness, (El) | 30.6 | 45.1 | 77.2 | 87.9 |

EXAMPLE 21

A slurry of unbleached softwood kraft pulp, having a consistency of 4.5%, by weight, was initially bleached with oxygen in the presence of alkali. Thereafter, the pulp slurry, which had a consistency of 1%, by weight, and a pH of 3, was bleached with an ozone/oxygen mixture passed through a sparge disc having 25 to 50 micron pores at a rate of 2.2 SCFH. The slurry was agitated with a turbine blade mixer at 3.26 HP-days/ton of pulp. After having consumed 0.93% ozone, the pulp which had a brightness of 55 (El), was extracted with sodium hydroxide. The slurry, during the extraction, had a consistency of 10% and a pH of 11. The extraction was conducted for a period of 90 minutes at 50° C.

Thereafter, the extracted pulp, which had a consistency of 10%, was treated with 2% peracetic acid for four hours at a slurry temperature of 70° C. and a pH of 8. The peracetic acid stage was followed by a second alkaline extraction stage identical to the alkaline extraction stage described above.

Finally, the pulp was treated with 1.2% peracetic acid under conditions identical to those employed in the peracetic acid stage described above. The pulp was then treated with sulfurous acid for a period of 30 minutes. The pulp slurry during this treatment had a consistency of 6%, a pH of 4 and was conducted at 50° C. The final brightness of the pulp was 83.6 Elrepho brightness.

Table VII below provides pertinent data for the properties of the pulp at various stages in the bleaching sequence.

TABLE VII

| Pulp Property | Unbleached Kraft | Oxygen Bleached | Ozone Bleached | $O_2O_3$ EPaEPa Bleached |
|---|---|---|---|---|
| Permanganate No. | 16.9 | 10.6 | 6.4 | — |
| Viscosity, cp | 34.6 | 23.6 | 14.40 | 10.9 |
| Brightness (El) | 24.6 | 31.6 | 55.0 | 83.6 |

EXAMPLE 22

A slurry of unbleached hardwood kraft pulp, having a consistency of 4.5%, by weight, was initially bleached with oxygen in the presence of alkali. Thereafter, the pulp of slurry which had a consistency of 2%, by weight, and a pH of 7 was bleached with an ozone/oxygen mixture passed through a sparge disc having 70 to 100 micron openings at a rate of 12.4 SCFH. The amount of ozone applied was 0.75%, by weight of O.D. pulp. The slurry was agitated with a three-bladed propeller mixer at 1 HP-days/ton of pulp. The pulp was thereafter extracted with hot water. The slurry, during the hot water extraction had a consistency of 6%. The extraction was conducted for a period of two hours at 49° C.

The extraction stage was followed by a second ozone stage identical to the ozone stage described above.

Thereafter, the extracted pulp, which had a consistency of 10%, by weight, was treated with 1% hydrogen peroxide and 2% sodium silicate for five hours at a slurry temperature of 70° C. and a pH of 10.5.

The peroxide bleached pulp was then extracted with sodium hydroxide for two hours at a temperature of 49° C. The pulp consistency was 10% and its pH was 11.0.

Thereafter, employing a pulp consistency of 10% and a temperature of 70° C. the pulp slurry was bleached for a period of five hours with 0.5% hydrogen peroxide on pulp.

The pulp slurry was then treated with sulfurous acid for a period of one hour. The pulp slurry during this treatment had a consistency of 3% and a pH of 4. The final brightness of the pulp was 82.4 Elrepho.

Table VIII below provides pertinent data for the properties of the pulp at various stages in the bleaching sequence.

TABLE VIII

| Pulp Property | Unbleached Kraft | Oxygen Bleached | Ozone Bleached | $O_2O_3EO_3$ PEP Bleached |
|---|---|---|---|---|
| Permanganate No. | 8.3 | 5.0 | 2.3 | — |

TABLE VIII-continued

| Pulp Property | Unbleached Kraft | Oxygen Bleached | Ozone Bleached | $O_2O_3EO_3$ PEP Bleached |
|---|---|---|---|---|
| Viscosity, cp | 23.3 | 15.4 | N.D. | 11.2 |
| Brightness, (El) | 33.3 | 48.7 | 62.7 | 82.4 |

EXAMPLE 23

A slurry of unbleached hardwood kraft pulp, having a consistency of 4.5%, by weight, was initially bleached with oxygen in the presence of alkali. Thereafter the pulp slurry which had a consistency of 1%, by weight, and a pH of 3 was bleached with an ozone/oxygen mixture passed through a sparge disc having 25 to 50 micron openings at a rate of 4 SCFH. The amount of ozone applied was 0.50%, by weight, of O.D. pulp. The slurry was agitated with a turbine blade mixer at 2.02 HP-days/ton of pulp. The pulp was thereafter extracted with sodium hydroxide. The slurry, during the alkaline extraction had a consistency of 10%, by weight, and a pH of 11.8. The extraction was conducted for a period of 90 minutes at 50° C.

The extraction stage was followed by a second ozone stage identical to the ozone stage described above.

The pulp was subsequently bleached with 0.6% chlorine dioxide applied at a pulp consistency of 11%, by weight. This stage was conducted for a period of two hours at 77° C.

Table IX below provides pertinent data for the properties of the pulp at various stages in the bleaching sequence.

TABLE IX

| Pulp Property | Unbleached Kraft | Oxygen Bleached | Ozone Bleached | $O_2O_3EO_3D$ Bleached |
|---|---|---|---|---|
| Permanganate No. | 9.5 | 6.15 | 2.3 | N.D. |
| Viscosity, cp | 23.4 | 17.14 | 11.9 | 14.1 |
| Brightness, (El) | 33.4 | 42.7 | 73.9 | 81.9 |

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A process for delignifying and bleaching lignocellulosic pulp, which comprises reacting a lignocellulosic pulp slurry, having a consistency of from about 1% to about 10%, by weight of oven-dried pulp, and a pH within the range of from about 1 to about 7 and a temperature between about 0° C. and about 70° C., with a gaseous mixture selected from the group consisting of ozone/oxygen, ozone/air, and a mixture thereof, in a reaction vessel, said gaseous mixture being in the form of bubbles substantially all of which are about ⅛ inch or less in diameter and having an ozone concentration of from about 0.1% to about 20%, by weight of oxygen or air, while agitating the pulp slurry at a rate of from about 0.01 to about 5.0 horsepower-days per ton of pulp.

2. A process of accordance with claim 1 wherein the concentration of the ozone is from about 2.0% to about 3.0%, by weight of oxygen or air.

3. A process in accordance with claim 1 wherein from about 0.1% to about 5.0% ozone, by weight of oven-dried pulp, is applied to the pulp slurry.

4. A process in accordance with claim 1 wherein the time of reaction is from about 1 minute to about 60 minutes.

5. A process in accordance with claim 1 wherein the agitation utilizes between about 0.1 horsepower-days to about 1.0 horsepower-days per ton of lignocellulosic pulp.

6. A process in accordance with claim 1 wherein the pulp consistency is from about 2% to about 3%, by weight of oven-dried pulp.

7. A process in accordance with claim 1 wherein the temperature of the slurry is from about 20° C to about 30° C.

8. A process in accordance with claim 1 wherein the pH of the pulp slurry is between about 3 and 5.

9. A process in accordance with claim 1 wherein said pulp slurry is subjected to oxygen bleaching in the presence of alkali prior to said reaction with ozone.

10. A process in accordance with claim 1 wherein said pulp slurry is subsequently bleached with peracetic acid.

11. A process in accordance with claim 1 wherein said pulp slurry is subsequently bleached with a peroxide compound.

12. A process in accordance with claim 1 wherein said pulp slurry, subsequent to said zone reacting, is subjected to the following bleaching sequence: extraction with sodium hydroxide or water, bleaching with an ozone containing gaseous mixture in accordance with claim 1 and then bleaching with peracetic acid.

13. A process in accordance with claim 1 wherein said pulp slurry, subsequent to said ozone reacting, is subjected to the following bleaching sequence: extraction with sodium hydroxide or water, bleaching with an ozone containing gaseous mixture in accordance with claim 1 and then bleaching with a peroxide compound.

14. A process in accordance with claim 1 wherein said pulp slurry, subsequent to said ozone reacting, is subjected to the following bleaching sequence: extraction with sodium hydroxide or water, bleaching with an ozone containing gaseous mixture in accordance with claim 1 and then bleaching with chlorine dioxide.

15. A process in accordance with claim 1 wherein said pulp slurry, subsequent to said ozone reacting, is subjected to the following bleaching sequence: extraction with sodium hydroxide or water, bleaching with an ozone containing gaseous mixture in accordance with claim 1 and then bleaching with a hypochlorite compound.

* * * * *

UNITED STATES PATENT AND TRADEMARK OFFICE

CERTIFICATE OF CORRECTION

PATENT NO. : 4,080,249

DATED : March 21, 1978

INVENTOR(S) : Arthur W. Kempf and Richard B. Phillips

It is certified that error appears in the above-identified patent and that said Letters Patent are hereby corrected as shown below:

On the front page, References Cited, U.S. PATENT DOCUMENTS, should appear as follows:

| | | | |
|---|---|---|---|
| 396,325 | 1/1889 | Brin | 162/65 |
| 415,608 | 11/1889 | Brin | 162/65 |
| 714,216 | 11/1902 | Menzies | 162/57 |
| 1,760,042 | 5/1930 | Crespi et al | 8/111 |
| 1,957,937 | 5/1934 | Campbell et al | 162/65 |
| 2,466,633 | 4/1949 | Brabender et al | 162/65x |
| 3,049,394 | 8/1962 | Wolinski | 8/55 |
| 3,149,906 | 9/1964 | Thorsen | 8/128 |
| 3,318,657 | 5/1967 | Wade | 8/111 |
| 3,352,642 | 11/1967 | Heidt et al | 23/222 |
| 3,451,888 | 6/1969 | Ancelle et al | 162/65 |
| 3,619,350 | 11/1971 | Marchfelder | 162/88x |
| 3,663,357 | 5/1972 | Liebergott | 162/65 |
| 3,719,552 | 5/1973 | Farley et al | 162/65 |
| 3,806,404 | 4/1974 | Liebergott et al | 162/65 |
| 3,829,357 | 8/1974 | Thompson et al | 162/65x |
| 3,832,276 | 8/1974 | Roymoulik et al | 162/65 |

On the front page, References Cited, FOREIGN PATENT DOCUMENTS, should appear as follows:

| | | |
|---|---|---|
| 185,421 | 8/1922 | Great Britain. |
| 694,720 | 9/1964 | Canada. |
| 902,861 | 6/1972 | Canada. |
| 966,604 | 4/1975 | Canada. |
| 970,111 | 7/1975 | Canada. |

UNITED STATES PATENT AND TRADEMARK OFFICE

CERTIFICATE OF CORRECTION

PATENT NO. : 4,080,249

DATED : March 21, 1978

INVENTOR(S) : Arthur W. Kempf and Richard B. Phillips

It is certified that error appears in the above-identified patent and that said Letters Patent are hereby corrected as shown below:

On the front page, References Cited, OTHER PUBLICATIONS, should appear as follows:

Osawa et al., TAPPI, 46(2):79 (1963).
Osawa et al., TAPPI, 46(2):84 (1963).
Soteland et al., Norsk Skogindustri [2] 1968:46.
Secrist, TAPPI, 54(4), p. 581-584 (1971).
Rothenberg et al., TAPPI, 58(8), p. 182-185 (1975).

Column 10, line 36, cancel "zone", insert--ozone--.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*